US011615725B2

(12) United States Patent
Chang et al.

(10) Patent No.: US 11,615,725 B2
(45) Date of Patent: Mar. 28, 2023

(54) DISPLAY PANEL

(71) Applicant: E Ink Holdings Inc., Hsinchu (TW)

(72) Inventors: Chia-Chi Chang, Hsinchu (TW); Chih-Chun Chen, Hsinchu (TW); Chi-Ming Wu, Hsinchu (TW); Yi-Ching Wang, Hsinchu (TW); Jia-Hung Chen, Hsinchu (TW); Wei-Yueh Ku, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/243,573

(22) Filed: Apr. 29, 2021

(65) Prior Publication Data

US 2021/0375172 A1 Dec. 2, 2021

(30) Foreign Application Priority Data

May 28, 2020 (TW) ..... 109117788

(51) Int. Cl.
*G09G 3/00* (2006.01)

(52) U.S. Cl.
CPC ..... *G09G 3/006* (2013.01)

(58) Field of Classification Search
CPC .. G09G 3/006; G09G 3/20; G09G 2300/0426; G09G 2310/0218
See application file for complete search history.

(56) References Cited

U.S. PATENT DOCUMENTS 7,129,923 B2 * 10/2006 Lu ..... G09G 3/006 702/57
2006/0017668 A1 * 1/2006 Shirasaki ..... G09G 3/3283 345/76

(Continued)

FOREIGN PATENT DOCUMENTS

CN 2757167 2/2006
CN 1746731 3/2006

(Continued)

OTHER PUBLICATIONS

"Office Action of Taiwan Counterpart Application", dated Jan. 19, 2021, p. 1-p. 3.

(Continued)

*Primary Examiner* — Akm Zakaria
(74) *Attorney, Agent, or Firm* — JCIPRNET

(57) ABSTRACT

A display panel including horizontal signal lines, vertical signal lines intersecting the horizontal signal lines, first transmission lines and second transmission lines is provided. The horizontal signal lines are divided into a first horizontal signal line group and an adjacent second horizontal signal line group. Each of the first and second horizontal signal line groups includes N horizontal lines, wherein N is a positive integer. The first transmission lines are positioned at a first side of the vertical signal lines and respectively connected to the N horizontal signal lines in the first horizontal signal line group in a first tendency. The second transmission lines are positioned at a second, opposite side of the vertical signal lines and respectively connected to the N horizontal signal lines in the second horizontal signal line group in a second tendency. The first tendency is opposite to the second tendency.

13 Claims, 1 Drawing Sheet

(56) References Cited

U.S. PATENT DOCUMENTS

| | | | | |
|---|---|---|---|---|
| 2007/0052651 | A1* | 3/2007 | Kim | G09G 3/2003 345/98 |
| 2008/0143653 | A1 | 6/2008 | Shishido | |
| 2009/0109149 | A1 | 4/2009 | Akimoto et al. | |
| 2009/0184911 | A1 | 7/2009 | Fukutome | |
| 2014/0353632 | A1 | 12/2014 | Park et al. | |
| 2018/0095336 | A1 | 4/2018 | Fukutome | |

FOREIGN PATENT DOCUMENTS

| | | |
|---|---|---|
| CN | 1749813 | 3/2006 |
| CN | 101821797 | 9/2010 |
| CN | 104143311 | 11/2014 |
| CN | 102959608 | 6/2015 |
| CN | 104914637 | 9/2015 |
| CN | 106406612 | 2/2017 |
| CN | 105609025 | 2/2018 |
| CN | 107919059 | 4/2018 |
| CN | 108597441 | 9/2018 |
| CN | 108682404 | 10/2018 |
| CN | 109285451 | 1/2019 |
| CN | 109637451 | 4/2019 |
| CN | 208752365 | 4/2019 |
| CN | 110867165 | 3/2020 |

OTHER PUBLICATIONS

"Office Action of China Counterpart Application", dated Nov. 10, 2022, p. 1-p. 10.

* cited by examiner

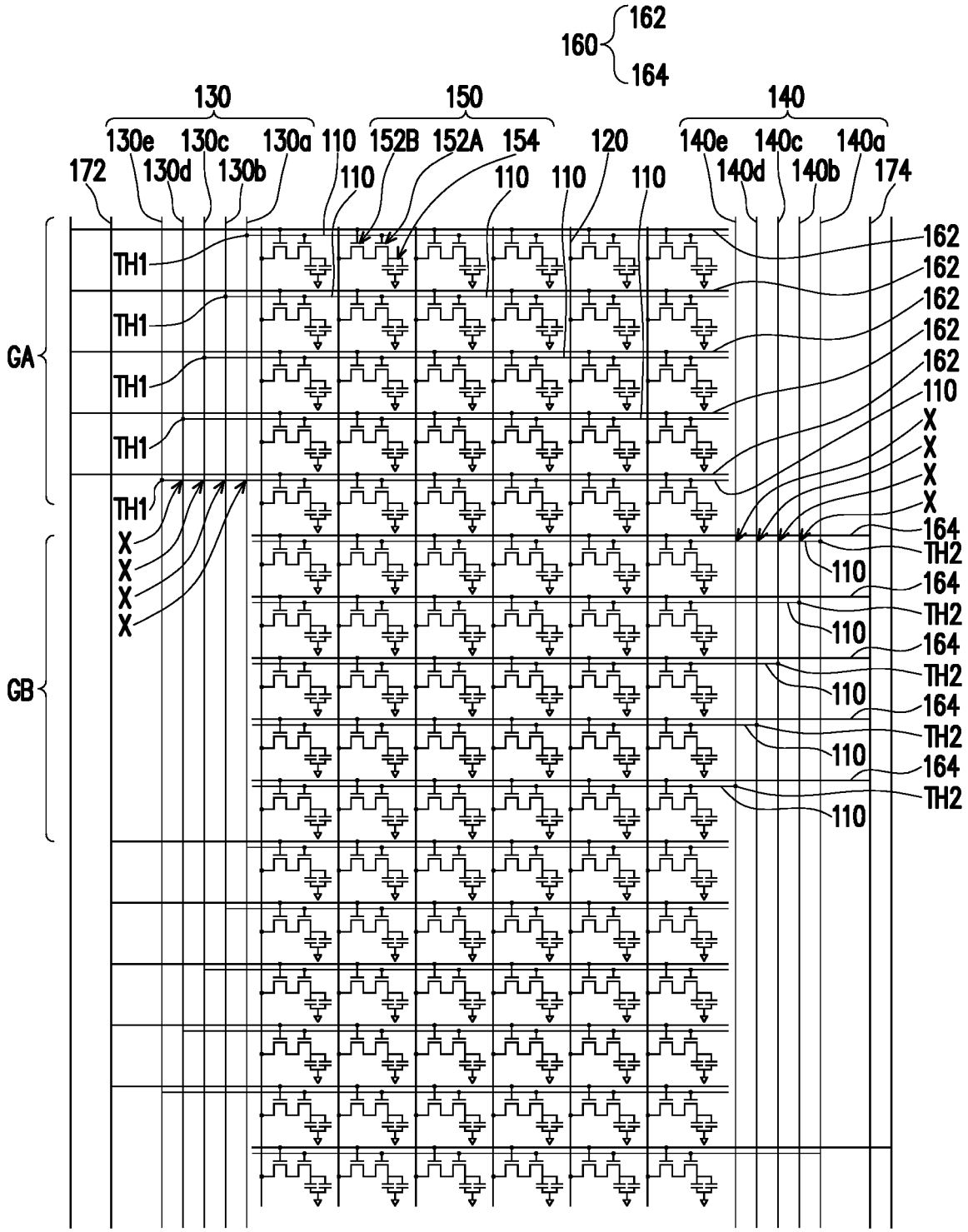
100

DISPLAY PANEL

CROSS-REFERENCE TO RELATED APPLICATION

This application claims the priority benefit of Taiwan application serial no. 109117788, filed on May 28, 2020. The entirety of the above-mentioned patent application is hereby incorporated by reference herein and made a part of this specification.

BACKGROUND

Technical Field

This disclosure relates to an electronic product, and in particular to a display panel.

Description of Related Art

With the popularization of electronic products, various display technologies are constantly being upgraded to meet the demands of more applications. For example, the border of the display panel has been constantly moving towards a narrower design, and many related technologies have also been derived. For example, multiple signal lines are usually disposed in a display panel. Using a design of a multiplex driving circuit in the signaling of the signal lines helps to reduce the number of peripheral wiring and achieve a narrow border. However, the design of the multiplex driving circuit increases the number of intersections among the lines, which may result in inconsistent signal transmission quality of the signal lines.

SUMMARY

This disclosure provides a display panel that can provide favorable display effect.

A display panel of the disclosure includes multiple horizontal signal lines, multiple vertical signal lines, multiple first transmission lines and multiple second transmission lines. The horizontal signal lines are parallel to each other and are divided into a first horizontal signal line group and a second horizontal signal line group adjacent to the first horizontal signal line group, and the first horizontal signal line group and the second horizontal signal line group each includes N horizontal lines, wherein N is a positive integer. The vertical signal line intersects multiple horizontal signal lines. The first transmission lines are positioned at a first side of the multiple vertical signal lines and are respectively connected to the N horizontal signal lines in the first horizontal signal line group in a first tendency. The second transmission lines are positioned at a second side of the multiple vertical signal lines, where the first side and the second side are on opposite sides. The second transmission lines are respectively connected to the N horizontal signal lines in the second horizontal signal line group in a second tendency, wherein the first tendency is opposite to the second tendency.

In an embodiment of the disclosure, the first tendency is that the first transmission line closer to the vertical signal lines is connected to the horizontal signal line in the first horizontal signal line group further away from the second horizontal signal line group, and the second tendency is that the second transmission line closer to the vertical signal lines is connected to the horizontal signal line in the second horizontal signal line group further away from the first horizontal signal line group.

In an embodiment of the disclosure, each of the N horizontal signal lines in the first horizontal signal line group is connected to the connected first transmission line through a first contact window, and each of the N horizontal lines in the second horizontal signal line group is connected to the connected second transmission line through a second contact window.

In an embodiment of the disclosure, the first contact window closer to the second horizontal signal line group in the vertical direction is farther away from the vertical signal lines, and the second contact window closer to the first horizontal signal line group in the vertical direction is farther away from the vertical signal lines.

In an embodiment of the disclosure, the display panel further includes multiple group signal lines. The multiple group signal lines include multiple first group signal lines disposed adjacent to the N horizontal signal lines in the first horizontal signal line group, and multiple second group signal lines disposed adjacent to the N horizontal signal lines in the second horizontal signal line group.

In an embodiment of the disclosure, the display panel further includes a first group transmission line and a second group transmission line. The multiple first group signal lines are connected to the first group transmission line, and the multiple second group signal lines are connected to the second group transmission line.

In an embodiment of the disclosure, the display panel further includes multiple pixel structures. Each of the multiple pixel structures is connected to one of the horizontal signal lines, one of the group signal lines, and one of the vertical signal lines.

In an embodiment of the disclosure, each of the multiple pixel structures includes a first active component, a second active component, and a pixel capacitor. A first end of the first active component is connected to one of the horizontal signal lines, a second end of the first active component is connected to the second active component, and a third end of the first active component is connected to the pixel capacitor. A first end of the second active component is connected to one of the group signal lines, a second end of the second active component is connected to one of the vertical signal lines, and the third end of the second active component is connected to the first active component.

In an embodiment of the disclosure, the multiple first transmission lines, the multiple second transmission lines and the multiple vertical signal lines are on the same layer.

In an embodiment of the disclosure, the multiple first transmission lines and the multiple second transmission lines intersect the multiple horizontal signal lines to form multiple interlaced points.

In an embodiment of the disclosure, the number of corresponding interlaced points of an $N^{th}$ horizontal signal line in the first horizontal signal line group and a first horizontal signal line in the second horizontal signal line group is the same.

In an embodiment of the disclosure, a number of corresponding interlaced points of the horizontal signal line in the first horizontal signal line group closer to the second horizontal signal line group is greater.

In an embodiment of the disclosure, a number of corresponding interlaced points of the horizontal signal line in the second horizontal signal line group closer to the first horizontal signal line group is greater.

In an embodiment of the disclosure, the horizontal signal lines are scan lines and the vertical signal lines are data lines.

Based on the above, the multiple horizontal signal lines in the display panel in the embodiments of the disclosure are divided into the first horizontal signal line group and the second horizontal signal line group, and the first transmission line and the second transmission line are utilized to deliver signals required by the horizontal signal lines. In addition, in the display panel of the embodiments of the disclosure, the first transmission lines are respectively connected to the N horizontal signal lines in the first horizontal signal line group in the first tendency, and the second transmission lines are respectively connected to the N horizontal signal lines in the second horizontal signal line group in the second tendency, and the first tendency is opposite to the second tendency. In this way, the transmission performance of the adjacent horizontal signal lines of the two adjacent groups are similar, which helps to provide favorable display quality.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

FIG. 1 is a partial schematic diagram of a display panel according to an embodiment of the disclosure.

DESCRIPTION OF THE EMBODIMENTS

Reference will now be made in detail to the present preferred embodiments of the disclosure, examples of which are illustrated in the accompanying drawings. Wherever possible, the same reference numbers are used in the drawings and the description to refer to the same or like parts.

FIG. 1 is a partial schematic diagram of a display panel according to an embodiment of the disclosure. As shown in FIG. 1, a display panel 100 includes multiple horizontal signal lines 110, multiple vertical signal lines 120, multiple first transmission lines 130, multiple second transmission lines 140, multiple pixel structures 150, multiple group signal lines 160, a first group transmission line 172, and a second group transmission line 174. The horizontal signal lines 110 and the vertical signal lines 120 have different extension directions respectively and are intersected with each other. The pixel structures 150 are arranged into an array between the horizontal signal lines 110 and the vertical signal lines 120 intersected with each other, and each pixel structure 150 is driven by one of the horizontal signal lines 110, one of the vertical signal lines 120 and one of the group signal lines 160 to carry out display. The vertical signal lines 120 are all disposed between the first transmission lines 130 and the second transmission lines 140. Respective extension directions of the first transmission lines 130 and the second transmission lines 140 may intersect with the extension direction of the horizontal signal lines 110. In other words, the first transmission lines 130 are positioned at a first side of the vertical signal lines 120, the second transmission lines 140 are positioned at a second side of the vertical signal lines 120, and the first side and the second side are on opposite sides.

In some embodiments, the first transmission lines 130 and the second transmission lines 140 may be parallel to the vertical signal lines 120. In addition, the first transmission lines 130 and the second transmission lines 140 are used to input corresponding signals to the horizontal signal lines 110. In some embodiments, the first transmission lines 130 and the second transmission lines 140 may be on the same layer, and the vertical signal lines 120 may also be on the same as the layer with the first transmission lines 130 and the second transmission lines 140, but is not limited thereto.

In the embodiment, the pixel structure 150 may include a first active component 152A, a second active component 152B, and a pixel capacitor 154. A first end of the first active component 152A may be connected to one of the horizontal signal lines 110, a second end of the first active component 152A may be connected to the second active component 152B, and a third end of the first active component 152A may be connected to the pixel capacitor 154. A first end of the second active component 152B may be connected to one of the group signal lines 160, a second end of the second active component 152B may be connected to one of the vertical signal lines 120, and a third end of the second active component 152B may be connected to the first active component 152A. A signal delivered on the horizontal signal line 110, for example, may be used to control switching on and off of the first active component 152A, and a signal delivered on the group signal line 160, for example, may be used to control switching on and off of the second active component 152B. When both the first active component 152A and the second active component 152B are switched on, a signal on the vertical signal line 120 may be inputted into the pixel capacitor 154 through the switched on first active component 152A and second active component 152B. At this time, the signal received by the pixel capacitor 154 may control a display medium to present a predetermined gray scale to display an image. Therefore, of the embodiment is described by setting the horizontal signal lines 110 as scan lines and the vertical signal lines 120 as data lines, but is not limited thereto. In the embodiment, the display medium used in the display panel 100 may include a liquid crystal material, an electrophoretic display medium, an electrowetting display medium, or an organic light-emitting material etc.

In the embodiment, each group signal line 160 is disposed adjacent to one of the horizontal signal lines 110, and the group signal lines 160 include multiple first group signal lines 162 and multiple second group signal lines 164. All the first group signal lines 162 are connected to the first group transmission line 172 and all the second group signal lines 164 are connected to the second group transmission line 174. Therefore, the horizontal signal lines 110 corresponding to the first group signal lines 162 and the horizontal signal lines 110 corresponding to the second group signal lines 164 may be divided respectively into a first horizontal signal line group GA and a second horizontal signal line group GB.

In the embodiment, the first horizontal signal line group GA and the second horizontal signal line group GB are disposed adjacent to each other, the first horizontal signal line group GA may include N horizontal signal lines 110, and the second horizontal signal line group GB may include N horizontal signal lines 110, where N is a positive integer. In the embodiment, an example where N is 5 is described, but the value of N is not limited thereto. In other embodiments, N may be other positive integers such as 8, or 16 etc. In other words, the first group signal lines 162 are group signal lines 160 disposed adjacent to the N horizontal signal lines 110 in the first horizontal signal line group GA, and the second group signal lines 164 are group signal lines 160 disposed adjacent to the N horizontal signal lines 110 in the second horizontal signal line group GB.

The group signal lines 160 may determine which of the pixel structures 150 of the first horizontal signal line group GA or the second horizontal signal line group GB may be electrically connected to the vertical signal line 120. For example, the group signal lines 160 may carry out an selection operation to switch on the second active components 152B of one of the first horizontal signal line group GA or the second horizontal signal line group GB, and to switch off the second active components 152B in the other group. Therefore, only the pixel structures 150 corresponding to the switched on second active components 152B can receive signals from the vertical signal lines 120. During display, multiple first transmission lines 130*a* to 130*e* may sequentially deliver selection signals, and the first group signal lines 162 may deliver group signals, wherein the group signals delivered on the first group signal lines 162 may last long enough to allow sequential scanning of the first transmission lines 130*a* to 130*e*. At this time, the first active components 152A and the second active components 152B of the first horizontal signal line group GA are all switched on and can enable the corresponding pixel structures 150 to receive the signals on the vertical signal lines 120. However, none of the second active components 152B in the second horizontal signal line group GB is switched on, so the pixel structures 150 of the second horizontal signal line group GB do not receive the signals delivered on the vertical signal lines 120.

Similarly, when the group signal lines 164 deliver the group signals and switch on the second active components 152B in the second horizontal signal line group GB, multiple second transmission lines 140*a* to 140*e* may sequentially deliver the selection signals to the corresponding horizontal signal lines 110. At this time, both the first active components 152A and the second active components 152B of the second horizontal signal line group GB are switched on and enable the corresponding pixel structures 150 to receive the signals on the vertical signal lines 120. However, none of the second active components 152B of the first horizontal signal line group GA is switched on, so the pixel structures 150 of the first horizontal signal line group GA do not receive the signals delivered on the vertical signal lines 120. With such a multiplexing driving design, the total number of the first transmission lines 130 and the second transmission lines 140 may be less than the total number of the horizontal signal lines 110, and helps to reduce the number of peripheral wirings and the configuration area.

In the embodiment, the first transmission lines 130 are respectively connected to the N horizontal signal lines 110 in the first horizontal signal line group GA in a first tendency, and the second transmission lines 140 are respectively connected to the N horizontal signal lines 110 in the second horizontal signal line group GB in a second tendency. The first tendency and the second tendency are opposite to each other. In the embodiment, the first tendency is that, for example, the first transmission line 130 closer to the vertical signal line 120 is connected to the horizontal signal line 110 in the first horizontal signal line group GA farther away from the second horizontal signal line group GB, and the second tendency is that, for example, the second transmission line 140 closer to the vertical signal line 120 is connected to the horizontal signal line 110 in the second horizontal signal line group GB farther away from the first horizontal signal line group GA. In other embodiments, the first tendency is that, for example, the first transmission line 130 closer to the vertical signal line 120 is connected to the horizontal signal line 110 in the first horizontal signal line group GA closer to the second horizontal signal line group GB, and the second tendency is that, for example, the second transmission line 140 closer to the vertical signal line 120 is connected to the horizontal signal line 110 in the second horizontal signal line group GB closer to the first horizontal signal line group GA.

For example, a first first transmission line 130*a*, a second first transmission line 130*b*, a third first transmission line 130*c*, a fourth first transmission line 130*d* and a fifth first transmission line 130*e* are disposed gradually away from the vertical signal line 120 in a sequential arrangement. The first tendency of the embodiment is that, for example, the first horizontal signal line 110 in the first horizontal signal line group GA that is connected with the first first transmission line 130*a* is farther away from the second horizontal signal line group GB as compared to other horizontal signal lines 110 in the first horizontal signal line group GA. In addition, a first second transmission line 140*a*, a second second transmission line 140*b*, a third second transmission line 140*c*, a fourth second transmission line 140*d*, and a fifth second transmission line 140*e* are, for example, disposed gradually towards the vertical signal line 120 in a sequential arrangement. The second tendency of this embodiment of the disclosure is that, for example, the first horizontal signal line 110 in the second horizontal signal line group GB is connected to the first second transmission line 140*a* is closer to the first horizontal signal line group GA as compared to other horizontal signal lines 110 in the second horizontal signal line group GB.

In such a circuit layout, each of the N (5) horizontal signal lines 110 in the first horizontal signal line group GA is connected to the connected first transmission line 130 via a first contact window TH1, and each of the N horizontal signal lines 110 in the second horizontal signal line group GB is connected to the connected second transmission line 140 via a second contact window TH2. In the vertical direction (a direction in which the vertical signal line extends), the first contact window TH1 closer to the second horizontal signal line group GB, is farther away from the vertical signal line 120, and the second contact window TH2 closer to the first horizontal signal line group GA in the vertical direction, is farther away from the vertical signal line 120. As a result, the last horizontal signal line 110 in the first horizontal signal line group GA may be connected to the first transmission line 130*e* farthest away from the vertical signal line 120, and the first horizontal signal line 110 in the second horizontal signal line group GB may be connected to the second transmission line 140*a* farthest away from the vertical signal line 120.

In the embodiment, the first transmission lines 130 and the second transmission lines 140 intersect the horizontal signal lines 110 to form multiple interlaced points X. Generally speaking, the coupling capacitance caused by the horizontal signal line 110 and the first transmission line 130 at the interlaced point X increases the load of the horizontal signal line 110 and impacts the signal transmission performance of the horizontal signal line 110. In addition, the greater the number of the interlaced points X on the same signal delivery path, the greater the impact on the signal transmission performance. Similarly, the number of the interlaced points X on the horizontal signal lines 110 and the second transmission line 140 also impacts the signal transmission performance. If the number of the corresponding interlaced points X differs significantly between adjacent horizontal signal lines 110, the pixel structures 150 corresponding to the two horizontal signal lines 110 may exhibit a difference in display effect. Therefore, in the embodiment, with the layout of the first transmission line 130 and the second transmission line 140, the display panel 100 can alleviate such difference and exhibit a favorable display effect.

For example, in the first horizontal signal line group GA, the horizontal signal line 110 closest to the second horizontal signal line group GB (that is, the last horizontal signal line 110 in the first horizontal signal line group GA) extends outward and intersects the first transmission line 130*a* first, followed by the first transmission line 130*b*, the first transmission line 130*c*, and the first transmission line 130*d* before being connected to the first transmission line 130*e*. Therefore, the signal delivery path of the last horizontal signal line 110 in the first horizontal signal line group GA includes 4 interlaced points X. In the second horizontal signal line group GB, the horizontal signal line 110 closest to the first horizontal signal line group GA (that is, the first horizontal signal line 110 in the second horizontal signal line group GB) extends outward and intersect the second transmission line 140*e* first, followed by the second transmission line 140*d*, the second transmission line 140*c*, and the second transmission line 140*b* before being connected to the second transmission line 140*a*. Therefore, the signal delivery path of the first horizontal signal line 110 in the second horizontal signal line group GB includes 4 interlaced points X. As a result, the last horizontal signal line 110 in the first horizontal signal line group GA and the first horizontal signal line 110 in the second horizontal signal line group GB are adjacent to each other, and may have similar signal transmission effect. In this way, when the first horizontal signal line group GA and the second horizontal signal line group GB are updated in sequence, the display effect near the boundary between the first horizontal signal line group GA and the second horizontal signal line group GB is approximately uniform, which helps to alleviate the block line mura in the display panel 100 that is caused by the grouping of the horizontal signal lines 110.

In the embodiment, the horizontal signal line 110 in the first horizontal signal line group GA closer to the second horizontal signal line group GB, is connected to the first transmission line 130 that is farther away from the vertical signal line 120, and the horizontal signal line 110 in the second horizontal signal line group GB that is closer to the first horizontal signal line group GA, is connected to the second transmission line 140 that is farther away from the vertical signal line 120. Therefore, the closer the horizontal signal line 110 in the first horizontal signal line group GA to the second horizontal signal line group GB, the greater the number of corresponding interlaced points X, while the closer the horizontal signal line 110 in the second horizontal signal line group GB to the first horizontal signal line group GA, the greater the number of corresponding interlaced points X. At the same time, the farther away the first transmission line 130 from the vertical signal line 120, the fewer the horizontal signal lines 110 the first transmission line 130 intersects, and the farther away the second transmission line 140 from the vertical signal line 120, the fewer the horizontal signal lines 110 the second transmission line 140 intersects. Therefore, the N horizontal signal lines 110 in the first horizontal signal line group GA have the same number of corresponding interlaced points X and substantially similar signal transmission quality, and the N horizontal signal lines 110 in the second horizontal signal line group GB also have the same number of corresponding interlaced points X and substantially similar signal transmission quality. Accordingly, the display device 100 can provide a uniform display effect.

In summary, the display panel in the embodiments of the disclosure includes multiple horizontal signal lines and multiple of vertical signal lines intersected to deliver signals to the pixel structures. In some embodiments, every N horizontal signal lines are defined as a group of horizontal signal line group, the display panel is disposed with multiple first transmission lines and multiple second transmission lines that correspond to the horizontal signal line groups, and the vertical signal lines are distributed between the first transmission lines and the second transmission lines. The first transmission lines and the second transmission lines intersect the corresponding horizontal signal lines to form multiple interlaced points. The number of corresponding interlaced points of each horizontal signal line is substantially the same; therefore resulting in the horizontal signal lines having a similar signal transmission quality. The display device therefore has an ideal display quality.

It will be apparent to those skilled in the art that various modifications and variations can be made to the structure of the disclosure without departing from the scope or spirit of the disclosure. In view of the foregoing, it is intended that the disclosure covers modifications and variations of this disclosure provided they fall within the scope of the following claims and their equivalents.

What is claimed is:

1. A display panel, comprising:

a plurality of horizontal signal lines, parallel to each other and divided into a first horizontal signal line group and a second horizontal signal line group adjacent to the first horizontal signal line group, and the first horizontal signal line group and the second horizontal signal line group each comprising horizontal signal lines;

a plurality of vertical signal lines intersecting the plurality of horizontal signal lines;

a plurality of first transmission lines positioned on a first side of the plurality of vertical signal lines, and respectively directly connected to the horizontal signal lines in the first horizontal signal line group; and a plurality of second transmission lines positioned on a second side of the plurality of vertical signal lines, the first side and the second side are opposite sides, and the plurality of second transmission lines are respectively directly connected to the horizontal signal lines in the second horizontal signal line group wherein a number of the first transmission lines, a number of the second transmission lines, a number of the horizontal signal lines in the first horizontal signal line group and a number of the horizontal signal lines in the second horizontal signal line group are identical, an $i^{th}$ first transmission line is located closer to the vertical signal lines than an $(i+1)^{th}$ first transmission line, the $i^{th}$ first transmission line is connected to an $i^{th}$ horizontal signal line of the first horizontal signal line group, and the $i^{th}$ horizontal signal line of the first horizontal signal line group is located farther away from the second horizontal signal line group than the $(i+1)^{th}$ horizontal signal line of the first horizontal signal line group, and an $i^{th}$ second transmission line is located closer to the vertical signal lines than an $(i+1)^{th}$ second transmission line, the $i^{th}$ second transmission line is connected to an $i^{th}$ horizontal signal line of the second horizontal signal line group, and the $i^{th}$ horizontal signal line of the second horizontal signal line group is located farther away from the first horizontal signal line group than the $(i+1)^{th}$ horizontal signal line of the second horizontal signal line group, wherein i is a positive integer smaller than the number of the first transmission lines.

2. The display panel according to claim 1, wherein each of the horizontal signal lines in the first horizontal signal line group is connected to the connected first transmission line via a first contact window, and each of the horizontal lines in the second horizontal signal line group is connected to the connected second transmission line via a second contact window.

3. The display panel according to claim 2, wherein the first contact window of the $(i+1)^{th}$ horizontal signal lines of the first horizontal signal line group is farther away from the vertical signal lines than the first contact window of the $i^{th}$ horizontal signal lines of the first horizontal signal line group, and the second contact window of the $(i+1)^{th}$ horizontal signal lines of the second horizontal signal line group is farther away from the vertical signal lines than second contact window of the $i^{th}$ horizontal signal lines of the second horizontal signal line group.

4. The display panel according to claim 1, further comprising a plurality of group signal lines, the plurality of group signal lines comprising a plurality of first group signal lines disposed adjacent to the horizontal signal lines in the first horizontal signal line group, and a plurality of second group signal lines disposed adjacent to the horizontal signal lines in the second horizontal signal line group.

5. The display panel according to claim 4, further comprising a first group transmission line and a second group transmission line, the plurality of first group signal lines being connected to the first group transmission line, and the plurality of second group signal lines being connected to the second group transmission line.

6. The display panel according to claim 4, further comprising a plurality of pixel structures, and each of the plurality of pixel structures being connected to one of the horizontal signal lines, one of the group signal lines, and one of the vertical signal lines.

7. The display panel according to claim 6, wherein each of the plurality of pixel structures comprises of a first active component, a second active component, and a pixel capacitor, a first end of the first active component is connected to the one of the horizontal signal lines, and a second end of the first active component is connected to the second active component, and a third end of the first active component is connected to the pixel capacitor, and a first end of the second active component is connected to the one of the group signal lines, a second end of the second active component is connected to the one of the vertical signal lines, and a third end of the second active component is connected to the first active component.

8. The display panel according to claim 1, wherein the plurality of first transmission lines, the plurality of second transmission lines and the plurality of vertical signal lines are on a same layer.

9. The display panel according to claim 1, wherein the plurality of first transmission lines and the plurality of second transmission lines intersect the plurality of horizontal signal lines to form a plurality of interlaced points.

10. The display panel according to claim 9, wherein a number of the interlaced points on the $i^{th}$ horizontal signal line in the first horizontal signal line group and a number of the interlaced points on the $i^{th}$ horizontal signal line in the second horizontal signal line group are the same.

11. The display panel according to claim 9, wherein a number of the interlaced points on the $(i+1)^{th}$ horizontal signal line in the first horizontal signal line group is greater than a number of the interlaced points on the $i^{th}$ horizontal signal line in the first horizontal signal line group.

12. The display panel according to claim 9, wherein a number of the interlaced points on the $(i+1)^{th}$ horizontal signal line in the second horizontal signal line group is greater than a number of the interlaced points on the $i^{th}$ horizontal signal line in the first horizontal signal line group.

13. The display panel according to claim 1, wherein the plurality of horizontal signal lines are scan lines and the plurality of vertical signal lines are data lines.

* * * * *